US008915304B2

(12) United States Patent
Richards et al.

(10) Patent No.: US 8,915,304 B2
(45) Date of Patent: Dec. 23, 2014

(54) TRAVERSING A TRAVEL JOINT WITH A FLUID LINE

(75) Inventors: William M. Richards, Frisco, TX (US); Cody T. Krupala, Midlothian, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 190 days.

(21) Appl. No.: 13/194,930

(22) Filed: Jul. 30, 2011

(65) Prior Publication Data

US 2013/0025880 A1 Jan. 31, 2013

(51) Int. Cl.

| | |
|---|---|
| ***E21B 33/038*** | (2006.01) |
| ***E21B 19/09*** | (2006.01) |
| ***E21B 17/07*** | (2006.01) |
| ***E21B 17/10*** | (2006.01) |

(52) U.S. Cl.

CPC ..... *E21B 17/07* (2013.01); *E21B 17/1035* (2013.01)

USPC ..... 166/381; 166/242.7; 166/355; 166/375; 285/145.1; 285/302

(58) Field of Classification Search

USPC ..... 166/335–368, 374, 375, 380, 381, 386, 166/85.1, 319, 332.1, 242.6, 242.7, 243; 175/321, 322; 285/121.1, 121.2, 285/124.1–124.5, 145.1, 302, 96, 106

See application file for complete search history.

(56) References Cited

U.S. PATENT DOCUMENTS

| | | | | |
|---|---|---|---|---|
| 3,718,183 | A * | 2/1973 | Scott | 166/359 |
| 4,178,020 | A * | 12/1979 | Dopyera | 285/18 |
| 4,453,599 | A | 6/1984 | Fredd | |
| 5,895,077 | A * | 4/1999 | Sigmundstad | 285/96 |
| 6,367,552 | B1 | 4/2002 | Scott et al. | |
| 6,540,025 | B2 | 4/2003 | Scott et al. | |
| 7,503,395 | B2 * | 3/2009 | Meijer et al. | 166/380 |
| 7,510,003 | B2 * | 3/2009 | Meijer et al. | 166/242.7 |
| 7,647,980 | B2 * | 1/2010 | Corre et al. | 166/387 |
| 7,726,396 | B2 * | 6/2010 | Briquet et al. | 166/242.6 |
| 7,806,190 | B2 * | 10/2010 | Du | 166/380 |
| 7,810,560 | B2 * | 10/2010 | Lembcke | 166/242.7 |
| 8,061,430 | B2 * | 11/2011 | Du et al. | 166/380 |
| 8,322,433 | B2 * | 12/2012 | Bedouet et al. | 166/345 |
| 2002/0092653 | A1 | 7/2002 | Scott et al. | |
| 2005/0072564 | A1 | 4/2005 | Grigsby et al. | |
| 2006/0000618 | A1 * | 1/2006 | Cho et al. | 166/381 |
| 2006/0260803 | A1 * | 11/2006 | Meijer et al. | 166/244.1 |

(Continued)

FOREIGN PATENT DOCUMENTS

WO 2008088226 A1 7/2008

OTHER PUBLICATIONS

Schlumberger Oilfield Glossary entry for "travel joint", accessed May 9, 2013 via www.glossary.oilfield.slb.com.*

(Continued)

*Primary Examiner* — Blake Michener

(74) *Attorney, Agent, or Firm* — Smith IP Services, P.C.

(57) ABSTRACT

A method of traversing a travel joint with a line can include, after the travel joint has been installed in a well, activating a connector which provides sealed fluid communication between sections of the line on respective opposite sides of the travel joint. A travel joint system for use with a subterranean well can include a travel joint comprising a releasing device which permits relative displacement between sections of the travel joint, and a connector which provides fluid communication between sections of a line.

20 Claims, 5 Drawing Sheets

(56) References Cited

U.S. PATENT DOCUMENTS

| | | | | |
|---|---|---|---|---|
| 2006/0260818 | A1* | 11/2006 | Meijer et al. | 166/380 |
| 2006/0283606 | A1* | 12/2006 | Partouche et al. | 166/380 |
| 2007/0144746 | A1* | 6/2007 | Jonas | 166/380 |
| 2008/0029274 | A1* | 2/2008 | Rytlewski et al. | 166/375 |
| 2008/0053652 | A1* | 3/2008 | Corre et al. | 166/179 |
| 2009/0032268 | A1* | 2/2009 | Blanton et al. | 166/386 |
| 2009/0078430 | A1* | 3/2009 | Du | 166/380 |
| 2010/0101778 | A1* | 4/2010 | Lembcke | 166/207 |
| 2010/0224375 | A1* | 9/2010 | Du et al. | 166/380 |
| 2010/0300698 | A1* | 12/2010 | Bedouet et al. | 166/355 |
| 2011/0017466 | A1* | 1/2011 | Averbuch et al. | 166/345 |
| 2011/0108286 | A1* | 5/2011 | Richards | 166/381 |

OTHER PUBLICATIONS

Search Report issued Jan. 24, 2013 for International Application No. PCT/US12/47143, 5 pages.

Written Opinion issued Jan. 24, 2013 for International Application No. PCT/US12/47143, 3 pages.

* cited by examiner

TRAVERSING A TRAVEL JOINT WITH A FLUID LINE

BACKGROUND

This disclosure relates generally to equipment utilized and operations performed in conjunction with a subterranean well and, in an example described below, more particularly provides for traversing a travel joint with a fluid line.

It is known to use a travel joint in a production tubing string to allow for dimensional variations between a wellhead and a packer or other tool engaged by the tubing string. Travel joints can be released for telescoping or otherwise longitudinally extending or compressing by means of various devices, such as shear pins, J-slots, metered hydraulic time releases, etc.

However, travel joints do not usually provide for extending fluid lines across the travel joints. It would be particularly difficult to traverse a travel joint with a chemical injection line, due in large part to relatively large diameters of typical chemical injection lines.

It will be appreciated that improvements are continually needed in the arts of constructing and operating travel joints.

SUMMARY

In the disclosure below, a travel joint system and associated methods are provided which bring improvements to the art. One example is described below in which a fluid line traverses a travel joint. Another example is described below in which sections of the fluid line are connected to each other in response to pressure being applied to the fluid line.

In one aspect of the disclosure below, a method of traversing a travel joint with a line is provided to the art. The method can include activating a connector which provides sealed fluid communication between sections of the line on respective opposite sides of the travel joint, after the travel joint has been installed in a well.

In another aspect of the disclosure, a travel joint system for use with a subterranean well is provided to the art. The system can include a travel joint comprising a releasing device that permits relative displacement between sections of the travel joint, and a connector that provides fluid communication between sections of a line.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
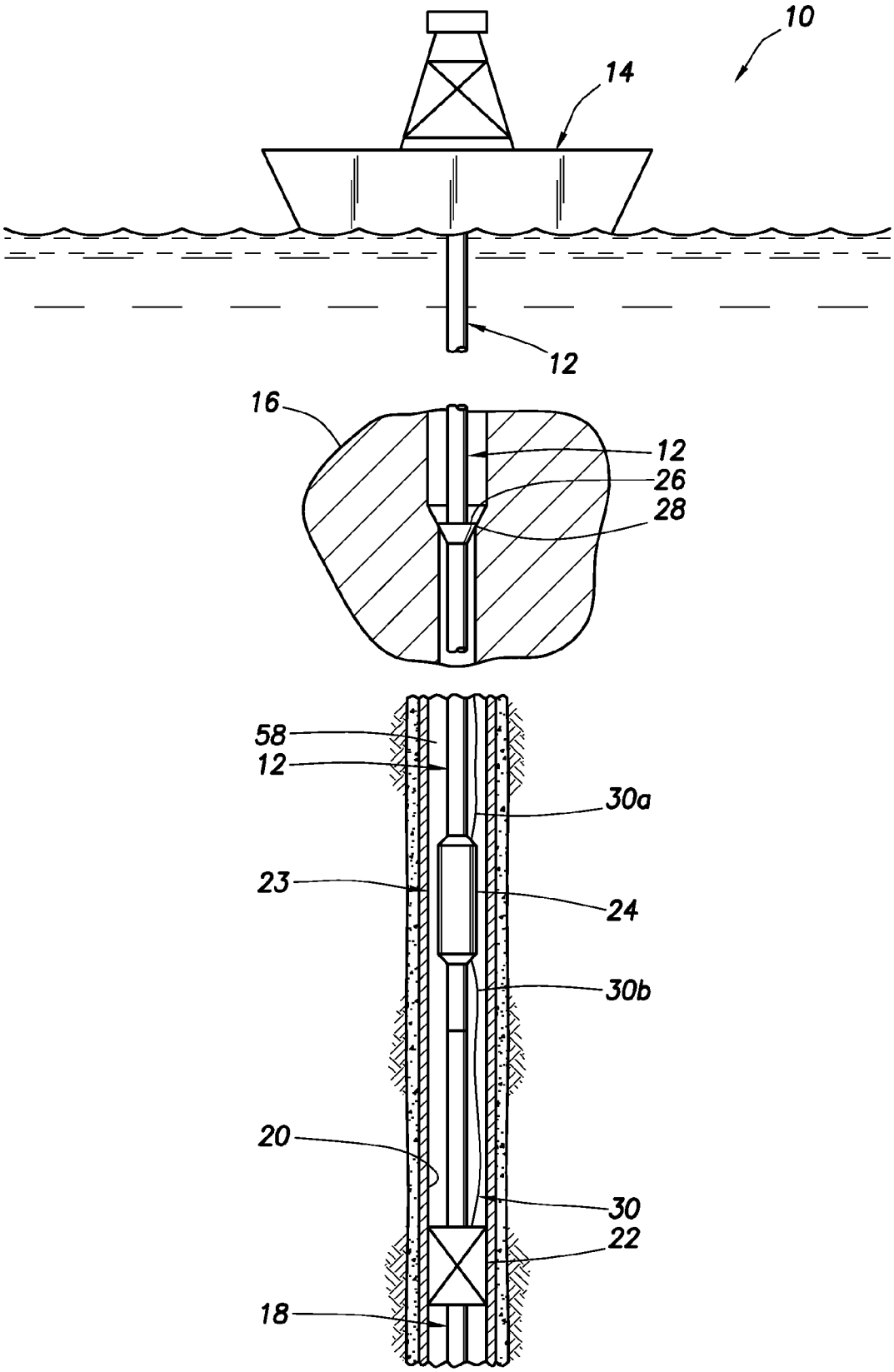
FIG. 1 is a representative partially cross-sectional view of a well system and associated method that can embody principles of this disclosure.

Representatively illustrated in FIG. 1 is a well system 10 and associated method that can embody principles of this disclosure. In the system 10, a tubular string 12 extends downwardly from a floating rig 14 (such as a drill ship, floating platform, etc.). The tubular string 12 may be in a riser (not shown) between the rig 14 and a wellhead 16, or a riser may not be used.

The tubular string 12 is stabbed into a completion assembly 18 previously installed in a wellbore 20. In the example depicted in FIG. 1, the tubular string 12 is sealingly received in a packer 22 at an upper end of the completion assembly 18.

In other examples, the tubular string 12 could have a seal stack thereon which seals within a sealed bore receptacle, e.g., above a liner hanger, etc. Any manner of connecting the tubular string 12 with the completion assembly 18 may be used in keeping with the scope of this disclosure.

The completion assembly 18 is preferably used to complete a portion of the well, that is, to prepare the well for production or injection operations. The completion assembly 18 could include elements which facilitate such production or injection (such as, packers, well screens, perforated liner or casing, production or injection valves, chokes, etc.).

A travel joint system 23 is used to provide for dimensional variations between the completion assembly 18 and the wellhead 16. After the tubular string 12 has been connected to the completion assembly 18, a travel joint 24 in the tubular string is released to allow the tubular string to be landed in the wellhead 16. In the example of FIG. 1, a hanger 26 is landed on a wear bushing 28, but other manners of securing a tubular string in a wellhead may be used in keeping with the scope of this disclosure.

The travel joint 24 permits some variation in the length of the tubular string 12 between the hanger 26 and the completion assembly 18. More specifically, the travel joint 24 preferably allows the length of the tubular string 12 to shorten after the completion assembly 18 has been sealingly engaged, so that the hanger 26 can be appropriately landed in the wellhead 16.

A suitable travel joint that has been used in the past for this purpose is described in U.S. Pat. No. 6,540,025, the entire disclosure of which is incorporated herein by this reference. The travel joint described in that patent includes a hydraulic release device which releases the travel joint in response to a predetermined compressive force being applied to the travel joint for a predetermined amount of time. The described travel joint also includes a resetting feature whereby the travel joint can be again locked in its extended configuration, after having been compressed.

However, other types of travel joints may be used for the travel joint 24 in the system 10, if desired. For example, travel joints which release in response to shearing one or more shear pins/screws, and travel joints which release by means of a J-slot or ratchet are available and are known to those skilled in the art.

One unique feature of the travel joint 24 in the system 10 is that the travel joint provides for fluid communication between sections 30*a, b* of a fluid line 30 on opposite sides of the travel joint. The line 30 may be used for any purpose (e.g., supplying pressure, supplying flow, telemetry, chemical injection, etc.) in keeping with the scope of this disclosure.

In the event that the line 30 is of a relatively large size (such as, the type used for chemical injection, etc.), it can be impractical to merely coil the line within the travel joint 24, so that the coil elongates or compresses along with the travel joint. Space limitations in the wellbore 20, for example, can prevent using such coiled large size lines in the travel joint 24.

Instead, the travel joint 24 includes provisions for establishing sealed fluid communication between the sections 30*a, b* of the line 30 after the travel joint has been released. Preferably, sealed fluid communication between the sections 30*a, b* is established after the tubular string 12 has connected with the completion assembly 18 and the tubular string has been landed in the wellhead 16, although other sequences of steps may be used in keeping with the scope of this disclosure.

At this point it should be noted that the system 10 and method are described herein as merely one example of how the principles of this disclosure may be used to advantage in a real world situation. However, it should be clearly understood that the principles of this disclosure are not limited in any manner to the details of the system 10, the method or the travel joint 24 examples described herein or depicted in the drawings.

Figure 2B:
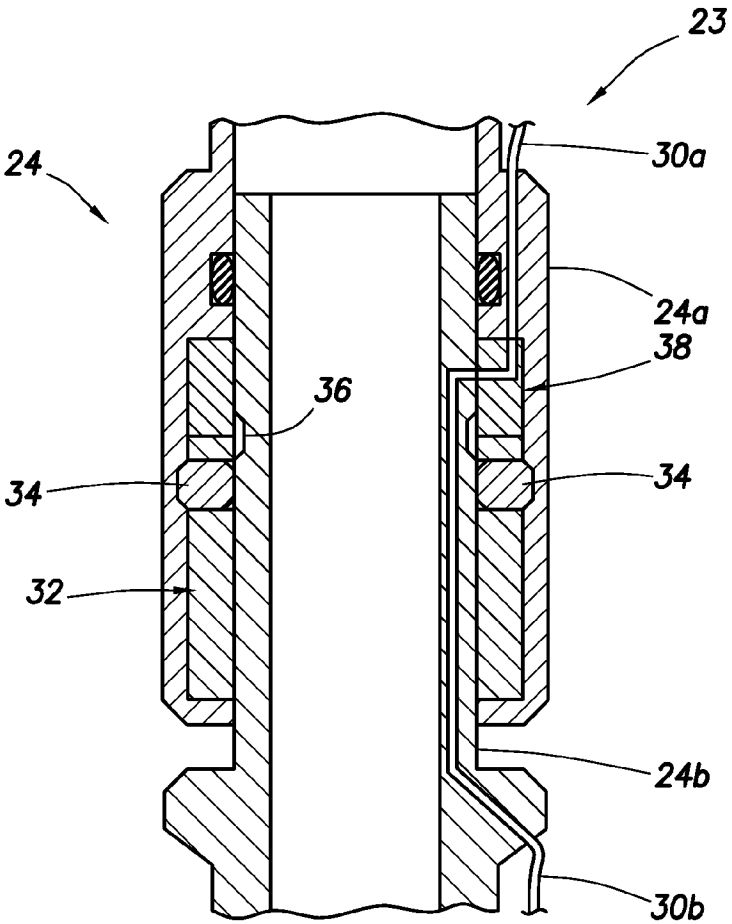
FIGS. 2A & B are representative cross-sectional views of a travel joint system that can embody principles of this disclosure.
Figure 2A:
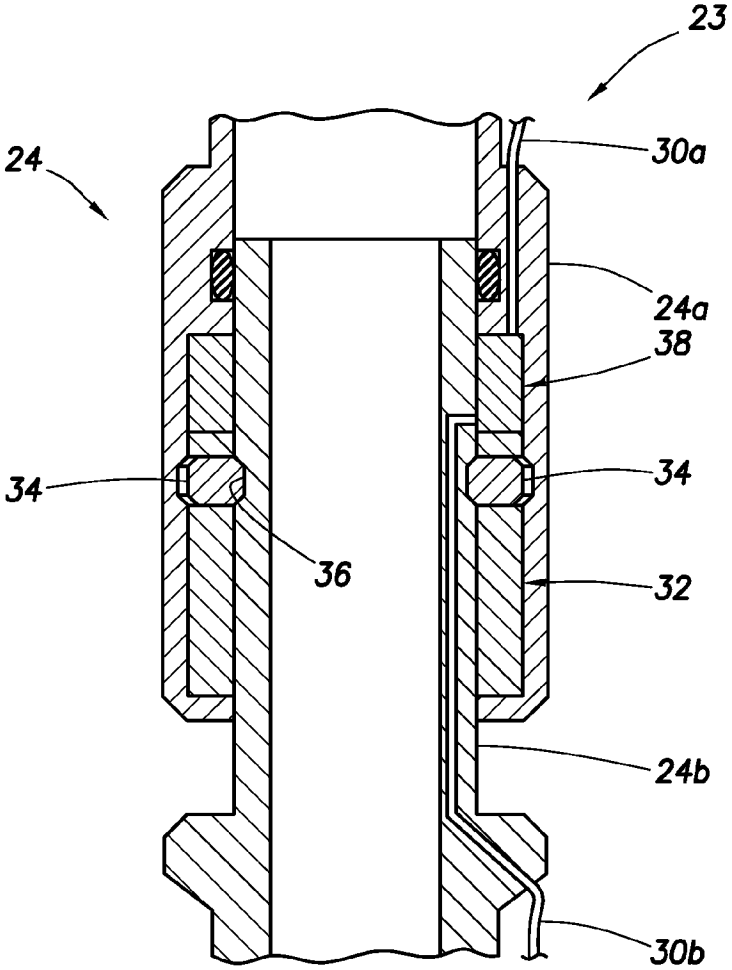

Referring additionally now to FIGS. 2A & B, representative cross-sectional views of the travel joint 24 are representatively illustrated, apart from the remainder of the system 10. The travel joint 24 can be used with the system 10, or it may be used with other well systems, in keeping with the scope of this disclosure.

In FIG. 2A, the travel joint 24 is shown in a locked configuration, in which sections 24*a, b* of the travel joint are prevented from displacing relative to each other. In FIG. 2B, the sections 24*a, b* of the travel joint 24 are released for displacement relative to each other.

In this example, the travel joint section 24*a* comprises an outer housing of the travel joint, and the travel joint section 24*b* comprises an inner tubular mandrel of the travel joint. The mandrel is sealingly received in the outer housing.

The travel joint section 24*a* includes a releasing device 32 which initially prevents relative displacement between the travel joint sections 24*a, b*, but which, when activated, permits relative displacement between the travel joint sections. The releasing device 32 is preferably similar to, or the same as, the hydraulic releasing device described in U.S. Pat. No. 6,540,025, but other types of releasing devices (such as, shear pins/screws, J-slots, ratchets, latches, etc.) may be used, if desired.

In the example of FIGS. 2A & B, the releasing device 32 includes dogs, lugs, collets or other latching members 34 which releasably engage a profile 36 formed on the mandrel section 24*b*. When the members 34 are disengaged from the profile 36, relative displacement is permitted between the travel joint sections 24*a, b* as depicted in FIG. 2B.

If the releasing device 32 is similar to that described in U.S. Pat. No. 6,540,025, the members 34 disengage from the profile 36 in response to a predetermined compressive force being applied to the travel joint 24 (e.g., by setting down weight of the tubular string 12 on the travel joint) for a predetermined period of time.

The travel joint 24 further includes a connector 38 which provides sealed fluid communication between the sections 30*a, b* of the line 30. As depicted in FIG. 2B, the connector 38 preferably provides such sealed fluid communication after the releasing device 32 is activated to permit relative displacement between the travel joint sections 24*a, b*, but in other examples the connector could provide such fluid communication prior to activating the releasing device.

Figure 3:
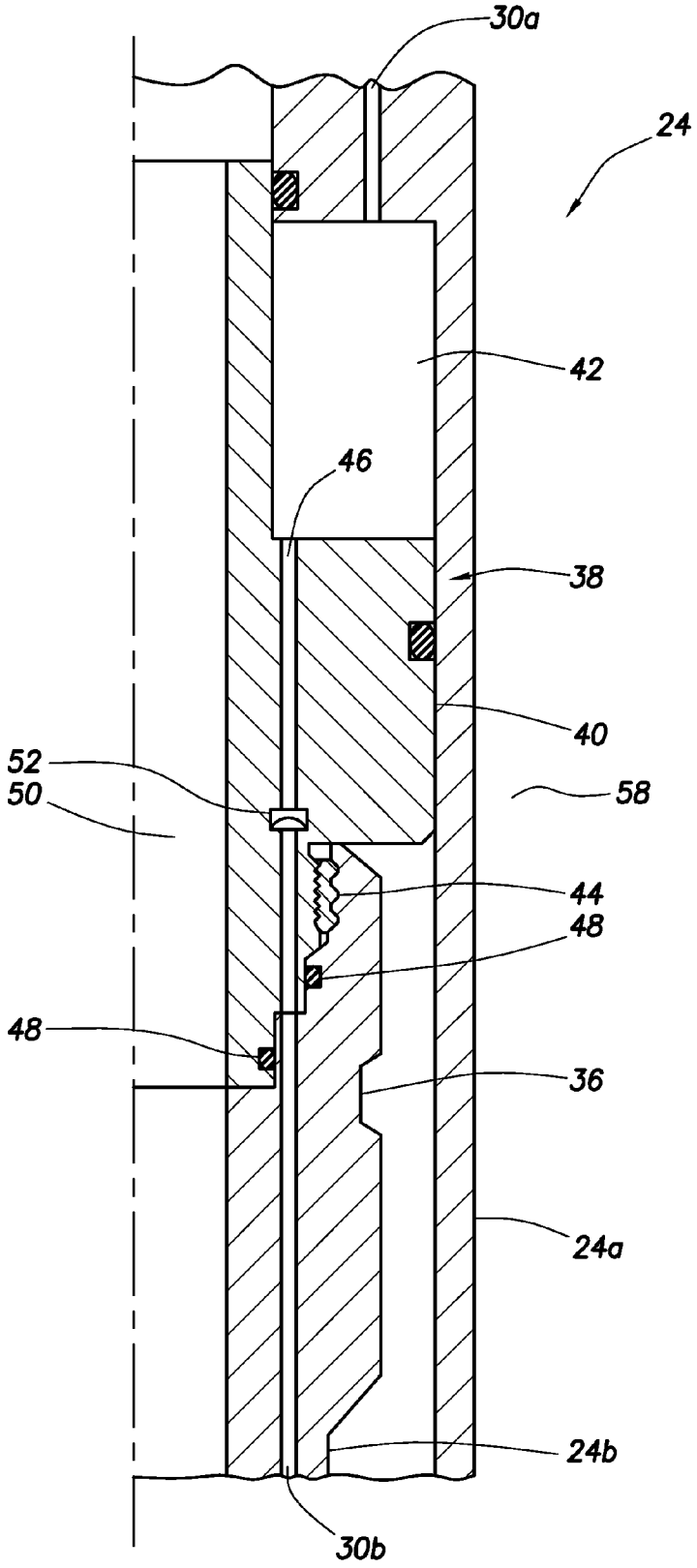
FIG. 3 is a representative enlarged scale cross-sectional view of a portion of a travel joint that can embody principles of this disclosure.

Referring additionally now to FIG. 3, a more detailed enlarged scale cross-sectional view of a portion of the travel joint 24 is representatively illustrated. In this configuration, the connector 38 includes a piston 40 which displaces downward (as viewed in FIG. 3) in response to elevated pressure being applied to a chamber 42 via the line section 30*a*.

A shear pin/screw (not shown) or other means may be used to prevent displacement of the piston 40 until a predetermined pressure differential is applied across the piston. The connector 38 is shown in FIG. 3 after the piston 40 has displaced downward.

When the piston 40 displaces downward, a ratchet-type latch 44 engages, preventing upward displacement of the piston. In this manner, the piston 40 is secured to the travel joint section 24*b*, and sealed fluid communication is provided through a passage 46 in the piston between the sections 30*a, b* of the line 30. Seals 48 isolate the passage 46 and sections 30*a, b* from communication with an internal flow passage 50, so that the line 30 traverses the travel joint 24.

After the piston 40 has displaced downward and is secured to the travel joint section 24*b*, pressure in the line section 30*a* is further increased to rupture a rupture disc 52, thereby permitting flow through the passage 46. Fluid pressure and flow can then be transmitted between the line sections 30*a, b* via the passage 46.

Figure 4:
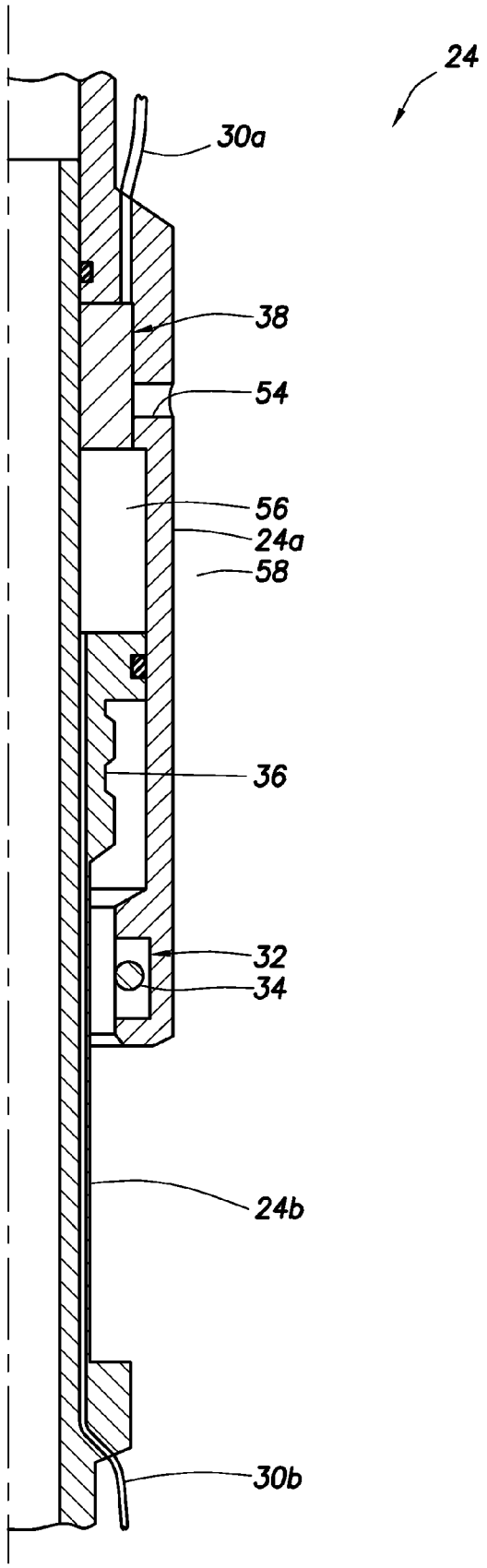
FIG. 4 is a representative cross-sectional view of another configuration of the travel joint.

Referring additionally now to FIG. 4, another configuration of the travel joint 24 is representatively illustrated. In this configuration, the travel joint 24 includes a pressure equalizing port 54 which allows pressure to equalize between an internal volume 56 of the travel joint and an exterior of the travel joint (such as, an annulus 58 formed radially between the tubular string 12 and the wellbore 20, see FIG. 1).

The volume 56 varies as the sections 24*a, b* of the travel joint 24 displace relative to each other. The equalizing port 54 permits fluid to flow between the volume 56 and the exterior of the travel joint 24.

Figure 5:
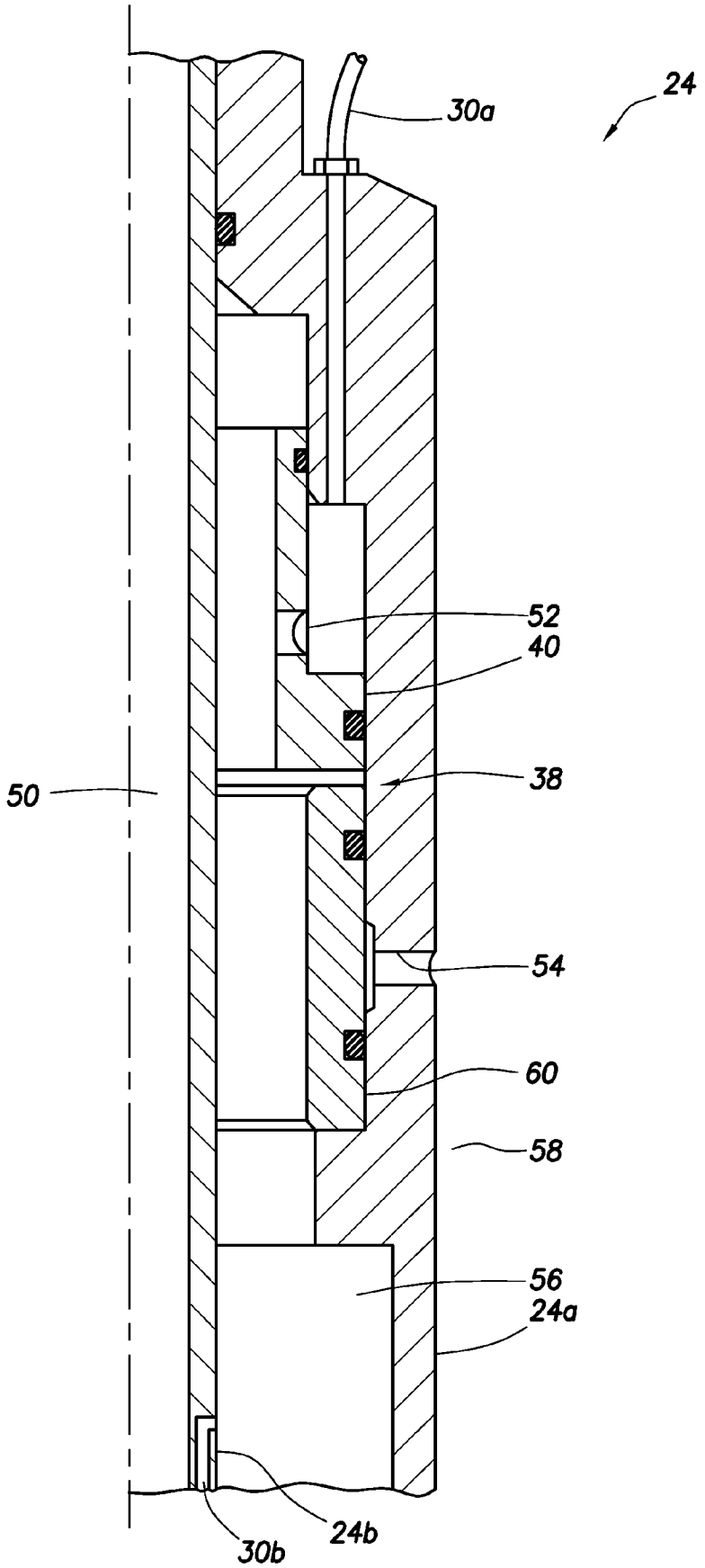
FIG. 5 is a representative enlarged scale cross-sectional view of a portion of the FIG. 4 travel joint configuration.

In one unique feature of this configuration of the travel joint 24, the connector 38 closes off the equalizing port 54 and places the line sections 30*a, b* in sealed fluid communication with each other via the volume 56. An enlarged scale and more detailed cross-sectional view of the connector 38 is representatively illustrated in FIG. 5.

In this view, it may be seen that the connector 38 includes the piston 40 which displaces downward in response to increased pressure being applied to the line section 30*a*. In addition, the connector 38 includes a valve 60 in the form of a sleeve which is displaced downward by the piston 40. The valve 60 prevents flow through the port 54 when the increased pressure is applied to the line section 30*a*.

After the piston 40 has been displaced downward, thereby closing the valve 60, pressure in the line section 30*a* is further increased to rupture the rupture disc 52.

Note that, in this configuration, the rupture disc 52 when ruptured provides fluid communication between the line section 30*a* and the volume 56.

The line section 30*b* is already in fluid communication with the volume 56. Thus, when the rupture disc 52 is ruptured, sealed fluid communication is provided between the line sections 30*a, b* via the volume 56.

It may now be fully appreciated that the disclosure above provides significant advancements to the art. The line 30 can effectively and conveniently traverse the travel joint 24. Sealed fluid communication between the sections 30*a, b* of the line 30 can be readily achieved by manipulating pressure in the line.

The above disclosure provides to the art a method of traversing a travel joint 24 with a line 30. The method can include, after the travel joint 24 has been installed in a well, activating a connector 38 which provides sealed fluid communication between sections 30*a, b* of the line 30 on respective opposite sides of the travel joint 24.

The sealed fluid communication may not be provided by the connector 38 prior to activating the connector 38.

The method can include releasing sections 24*a, b* of the travel joint 24 for displacement of the travel joint sections 24*a, b* relative to each other, prior to activating the connector 38.

Activating the connector 38 may include manipulating pressure in the line 30.

Activating the connector 38 may be performed after a tubular string 12 is connected with a completion assembly 18, with the travel joint 24 being interconnected in the tubular string 12.

Activating the connector 38 may be performed after a tubular string 12 is landed in a wellhead 16, with the travel joint 24 being interconnected in the tubular string 12.

Activating the connector 38 can include increasing pressure in the line 30 to a predetermined level, displacing a piston 40 and/or rupturing a rupture disc 52.

Activating the connector 38 may include preventing fluid communication with an internal volume 56 of the travel joint 24, the internal volume 56 varying in response to relative displacement between sections 24*a, b* of the travel joint 24.

Also described above is a travel joint system 23 for use with a subterranean well. The system 23 can include sections 30*a, b* of a line 30, and a travel joint 24 including a releasing device 32 which permits relative displacement between sections 24*a, b* of the travel joint 24, and a connector 38 which provides fluid communication between the sections 30*a, b* of the line 30.

The connector 38 may include at least one piston 40 responsive to pressure manipulations in at least one of the sections 30*a, b* of the line 30.

The connector 38 may comprise a device (such as the rupture disc 52) which opens in response to a predetermined pressure level in at least one of the sections 30*a, b* of the line 30.

The connector 38 may provide fluid communication between the sections 30*a, b* of the line 30 while relative displacement is permitted between the sections 24*a, b* of the travel joint 24.

The connector 38 may include a valve 60 which closes off a pressure equalizing port 54. The valve 60 may prevent fluid communication with an internal volume 56 of the travel joint 24, which volume 56 varies in response to relative displacement between the travel joint sections 24*a, b*, and/or which volume 56 is placed in fluid communication with the sections 30*a, b* of the line 30 by the connector 38.

The travel joint 24 may be interconnected in a tubular string 12 between a wellhead 16 and a completion assembly 18, whereby the line 30 traverses the travel joint 24 between the wellhead 16 and the completion assembly 18.

The connector 38 may initiate fluid communication between the sections 30*a, b* of the line 30 while the travel joint 24 is positioned in the well.

Each of the sections 30*a, b* of the line 30 is preferably attached to a respective one of the sections 24*a, b* of the travel joint 24.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of traversing a travel joint with a line, the method comprising:

assembling a travel joint and first and second sections of the line in a tubular string, the first and second sections being on respective opposite sides of the travel joint;

then installing the travel joint in a well; and then activating a connector which provides sealed fluid communication between the first and second sections of the line.

2. The method of claim 1, wherein sealed fluid communication is not provided by the connector prior to activating the connector.

3. The method of claim 1, further comprising releasing sections of the travel joint for displacement of the travel joint sections relative to each other, prior to activating the connector.

4. The method of claim 1, wherein activating the connector further comprises manipulating pressure in the line.

5. The method of claim 1, wherein activating the connector is performed after the tubular string is connected with a completion assembly.

6. The method of claim 1, wherein activating the connector is performed after the tubular string is landed in a wellhead.

7. The method of claim 1, wherein activating the connector further comprises increasing pressure in the line to a predetermined level.

8. The method of claim 1, wherein activating the connector further comprises displacing a piston.

9. The method of claim 1, wherein activating the connector further comprises rupturing a rupture disc.

10. The method of claim 1, wherein activating the connector further comprises preventing fluid communication between an internal volume of the travel joint and an exterior of the travel joint, the internal volume varying in response to relative displacement between sections of the travel joint.

11. A travel joint system for use with a subterranean well, the system comprising:

a travel joint which provides for dimensional variations between a completion assembly and a wellhead, the travel joint including a releasing device which initially prevents relative displacement between telescoping members of the travel joint;

first and second sections of a line on respective opposite sides of the travel joint; and a connector which provides fluid communication between the sections of the line, the connector being positioned between the telescoping members of the travel joint.

12. The system of claim 11, wherein the connector comprises at least one piston responsive to pressure manipulations in at least one of the sections of the line.

13. The system of claim 11, wherein the connector comprises a device which opens in response to a predetermined pressure level in at least one of the sections of the line.

14. The system of claim 11, wherein the connector provides fluid communication between the sections of the line while relative displacement is permitted between the telescoping members of the travel joint.

15. The system of claim 11, wherein the connector includes a valve which closes off a pressure equalizing port.

16. The system of claim 15, wherein the valve prevents fluid communication between an internal volume of the travel joint and an exterior of the travel joint, which volume varies in response to relative displacement between the telescoping members of the travel joint.

17. The system of claim 15, wherein the valve prevents fluid communication between an internal volume of the travel joint and an exterior of the travel joint, which volume is placed in fluid communication with the sections of the line by the connector.

18. The system of claim 11, wherein the travel joint is interconnected in a tubular string between the wellhead and the completion assembly, whereby the line traverses the travel joint between the wellhead and the completion assembly.

19. The system of claim 11, wherein the connector initiates fluid communication between the sections of the line while the travel joint is positioned in the well.

20. The system of claim 11, wherein each of the sections of the line is attached to a respective one of the telescoping members of the travel joint.

* * * * *